US005873457A

United States Patent [19]

Madweb

[11] Patent Number: 5,873,457

[45] Date of Patent: Feb. 23, 1999

[54] ANTI-THEFT WATCH BOX

[75] Inventor: Mark Madweb, Kingston, Pa.

[73] Assignee: M. Z. Berger & Co., Long Island City, N.Y.

[21] Appl. No.: 569,588

[22] Filed: Dec. 8, 1995

[51] Int. Cl.[6] ..... B65D 85/40

[52] U.S. Cl. ..... 206/301; 206/1.5; 206/6.1; 312/219

[58] Field of Search ..... 206/387.11, 308.2, 206/807, 301, 1.5, 751, 754, 6.1, 566; 368/10; 211/4; 312/216, 217, 219; 292/251.5; 70/71

[56] References Cited

U.S. PATENT DOCUMENTS

| | | | |
|---|---|---|---|
| 3,499,376 | 3/1970 | Swift . | |
| 3,780,634 | 12/1973 | Van Osch . | |
| 4,221,479 | 9/1980 | Harvey . | |
| 4,300,674 | 11/1981 | Davet | 206/6.1 |
| 4,511,041 | 4/1985 | Waitzman | 206/566 |
| 4,830,181 | 5/1989 | Hartman | 206/6.1 |
| 5,109,242 | 4/1992 | Massarsky . | |
| 5,148,198 | 9/1992 | Shiba . | |
| 5,202,713 | 4/1993 | Nakai et al. . | |
| 5,579,906 | 12/1996 | Fabbri et al. | 206/301 |

*Primary Examiner*—Paul T. Sewell
*Assistant Examiner*—Nhan T. Lam
*Attorney, Agent, or Firm*—Helfgott & Karas,P C.

[57] ABSTRACT

In the present invention, the watch is mounted in a conventional hollow collar which is in turn positioned in a display box. A slit in the display box allows a securing member to be slipped through the box and the watch collar. The securing member is locked to the wall of the box on the other side of the watch collar by an anti-theft locking means. The end of the securing member has a pin which is inserted into the locking means and is held in place until released by a release mechanism, such as by a magnet. Such a release mechanism, opens the locking means and allows the securing member to be withdrawn. The end of the securing member opposite the pin, projects out of the box both to form a handle to aid in the removal of the securing member and as a visual indicator that the securing device remains inserted in the watch box.

7 Claims, 2 Drawing Sheets

FIG. 1
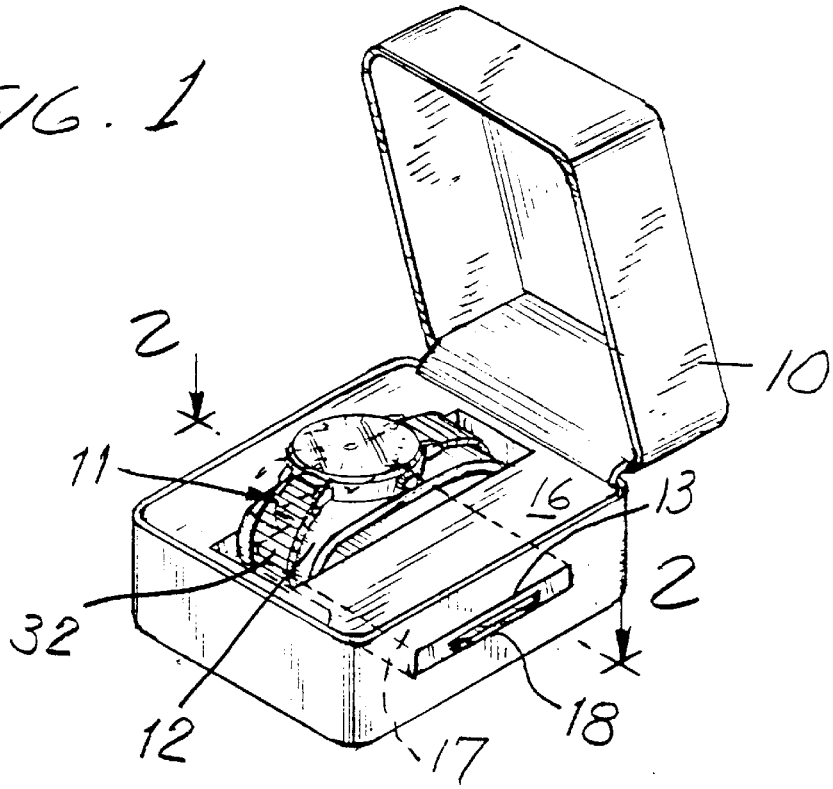
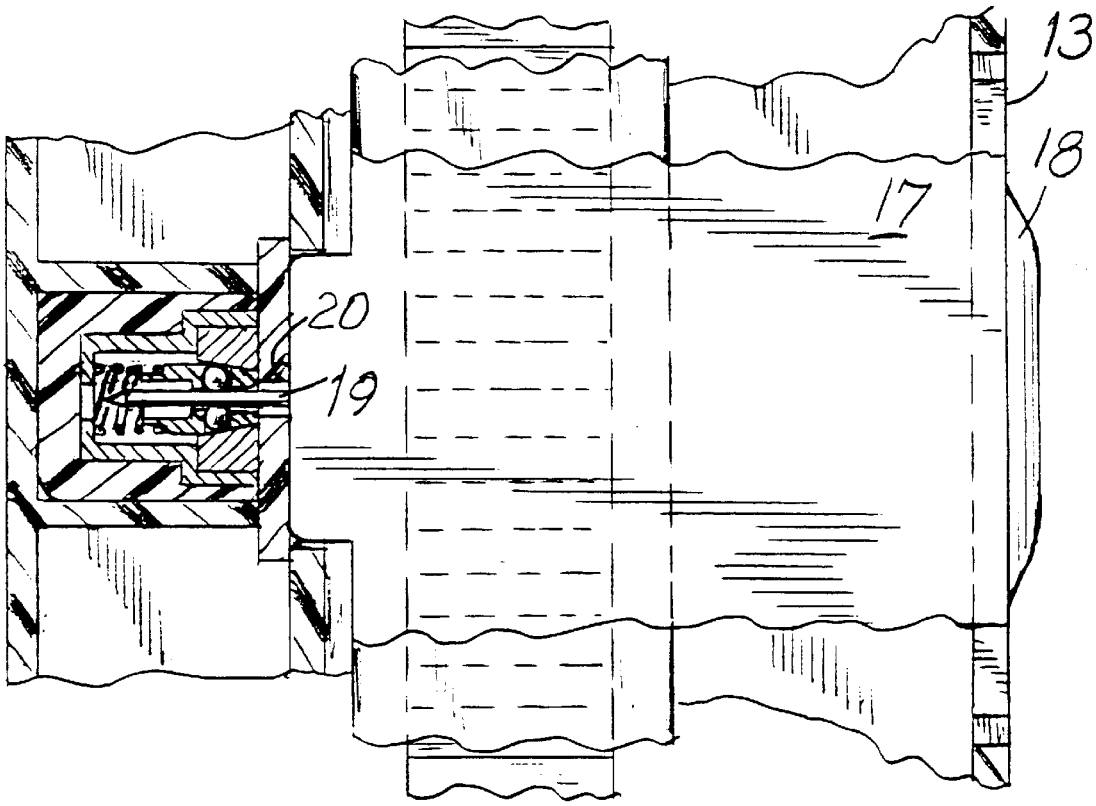
FIG. 2

ANTI-THEFT WATCH BOX

BACKGROUND OF THE INVENTION

The present invention relates to a watch display box and more particularly to an anti-theft watch display box.

Normally, watches are sold, mounted in boxes which, when opened, can act as displays for the watches, but which when closed, do not show whether the watch is in the box. One of the most common forms of theft shrinkage in stores results from the removal of the watch from the display box and replacement of the box in its normal storage area. When this occurs, theft is not normally not discovered during inventory since the box is not opened. It is only discovered when the box is reopened, which event may occur well after the actual theft of the watch. Similarly, watches may be stolen by customers who can delay discovery by leaving a closed box. Since it is necessary that the watch cases be available to be opened for display purposes, the watches cannot be kept in sealed containers.

Thus, it is important that there be a security device which locks the watch in place in the box while at the same time allowing the watch to be displayed in the box for sales purposes. It is necessary that such a system be difficult to be removed by unauthorized personnel but easily removed for legitimate sale of the goods.

SUMMARY OF THE INVENTION

The primary object of the present invention is to provide a means to secure a watch firmly in the box so that the watch cannot be removed from the box by unauthorized personnel, but will allow the display of the watch and which security device can easily be removed upon sale of the watch without destruction of the box.

It is also an object to have an external indication that the security device is in place.

In the present invention, the watch is mounted in a conventional hollow collar which is in turn positioned in a display box. A slit in the display box allows a securing member to be slipped through the box and the watch collar. The securing member is locked to the wall of the box on the other side of the watch collar by an anti-theft locking means. The end of the securing member has a pin which is inserted into the locking means and is held in place until released by a release mechanism, such as by a magnet. Such a release mechanism, opens the locking means and allows the securing member to be withdrawn. The end of the securing member opposite the pin, projects out of the box both to form a handle to aid in the removal of the securing member and as a visual indicator that the securing device remains inserted in the watch box.

Such a system secures the watch in place in the box such that it can be visibly displayed for sale but cannot be easily removed from the box without an appropriate release mechanism. This helps prevent shrinkage due to theft on two levels. It prevents shrinkage in the storage area by employees. In stealing watches, employees normally leave the box so the box will be counted in any inventory and, thus, the theft hidden. In accordance with the present invention, the watch cannot be readily removed from the box without a release mechanism and the box itself displays an indication that the security device is currently inserted in the box. Thus, losses will be discovered either through disappearance of the box or lack of security member. Similarly, such device prevents shrinkage by customers since they will be unable to remove the watch from the watch box without an appropriate release device and, thus, in stealing the watch would not only have to steal the easily hidden watch itself, but the entire, much bulkier container.

BRIEF DESCRIPTION OF THE DRAWINGS

The preferred embodiment of the invention has been chosen for the purpose of illustration and description as shown in the accompanying drawings in which:

FIG. 1 is a perspective view of an anti-theft watch box in accordance with the present invention with a watch locked in position;

FIG. 2 is a partial cut-away view showing the watch box and watch band at plane 2—2 of FIG. 1;

DETAILED DESCRIPTION OF THE PREFERRED EMBODIMENT

Figure 3:
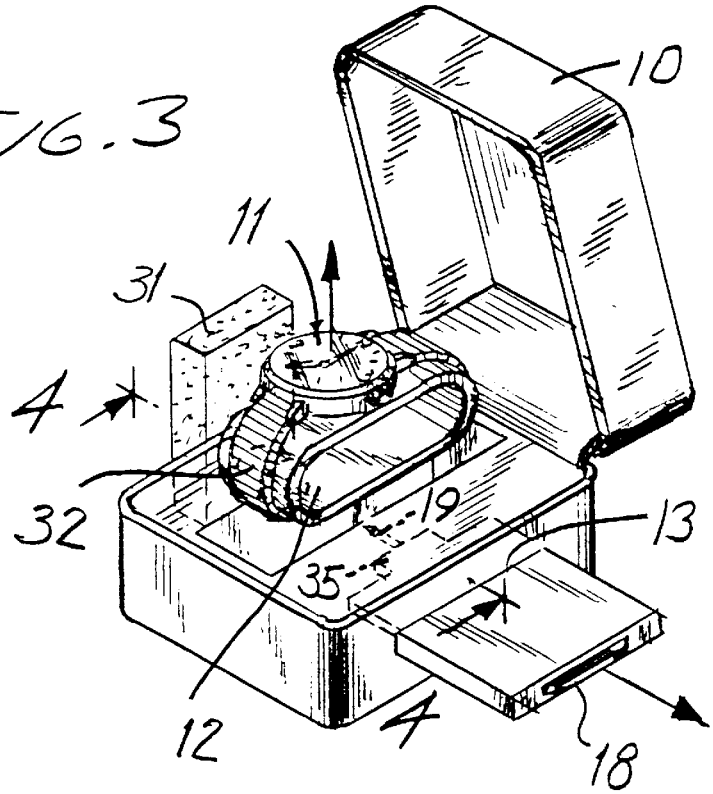
FIG. 3 is a perspective view of a watch box and watch in accordance with the present invention showing the security device released by a magnetic means.
Figure 4:
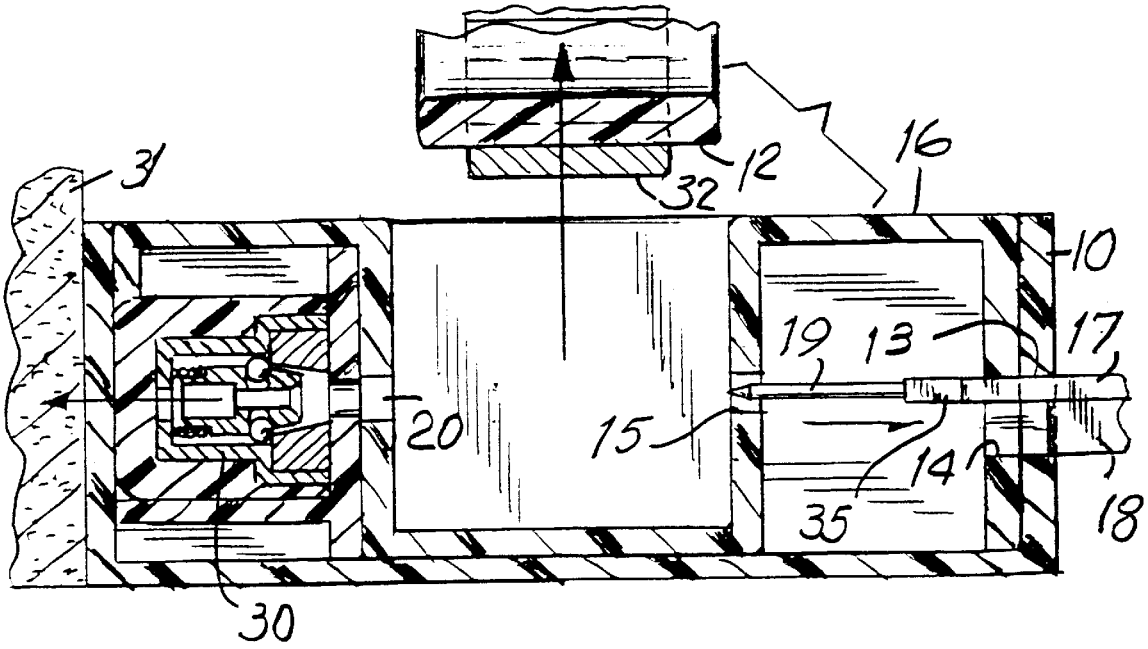
FIG. 4 is a partial cut-away view of the device taken at plane 4—4 of FIG. 3.

FIG. 1 shows a watch box 10 in which a watch 11 is supported on a hollow watch collar 12. The box has an insert 16 which holds the watch 11 and the watch collar 12 in position in the box 10. Without a security means, the watch 11 and watch collar 12 can be easily removed. If no anti-theft features exist, the watch could be removed, the box closed and replaced, thus delaying discovery of a theft. Normal inventories, based on a simple box count, would not show the theft.

To prevent such theft, the anti-theft watch box of the present invention has a slot 13 on one side of the container, with corresponding slots 14 and 15 in vertical walls 25 and 26 of insert 16 of the conventional box interior walls. A security member 17 made of plastic or other rigid material has a handle 18 at one end and a pin 19 mounted in a necked portion 35 of security member 17. The security member 17 is inserted, pin 19 first, through the slots 13, 14 and 15. The security member 17 passes through the hollow watch collar 12. The pin 19 passes through an opening 20 in vertical wall 27 of insert 16 and into a locking device 30. The locking device 30 may be of any type which locks the pin in place upon insertion and only releases the pin upon the application of an appropriate release device. Such a system is disclosed in U.S. Pat. No. 3,974,581 issued to Martens et al., on Aug. 17, 1976. The pin is held in place by a crimping device which is released only upon application of a magnet 31.

In operation, the watch 11 is mounted on watch collar 12, the watch band 32 being positioned around the external surface of the watch collar 12. The watch is positioned in the box 10 and held in place by the walls 26 and 27 of insert 16. The security member 17 is positioned through slots 13, 14 and 15 and watch collar 12. Pin 19 passes through hole 20 and is inserted in locking device 30. Thus, security member 17 is locked in place in the box which in turn locks the surrounding watch in place.

When so mounted, the watch 11 cannot be removed from the box without a release device 31. The handle 18 of support member 17 not only acts as a grip for insertion and removal of the member 17 but acts as a visual indicator that the security member 17 is still properly mounted in the box 10.

After a sale is made, the release device 31 is positioned external of the box. Device 31 then acts to release the pin 19 and allows its removal. If desired security member 17 can contain a conventional alarm circuit, not shown, which would trigger an alarm if an attempt is made to remove the box 10 from the store without removal of support member 17.

While the invention has been described as having a preferred design, it is understood that it is capable of further modification, uses and/or adaptations of the invention following in general the principal of the invention and including such departures from the present disclosure as come within known or customary practice in the art to which the invention pertains, as may be applied to the central figures hereinabove set forth and fall within the scope of the invention of the limits of the appended claims.

I claim:

1. An anti-theft box for a watch, said box comprising:

a box having an opening on one side, a hollow watch collar disposed in the box, wherein the watch is supported on the watch collar;

a rigid security member which is steadily mounted in said opening and is so positioned that it will pass through the hollow watch collar in the box, and a locking means in the side of the box opposite from that containing the opening which locks the security member in place in the box.

2. An anti-theft box according to claim 1 which further includes means positioned external of the box for releasing the security member from the locking means.

3. An anti-theft box according to claim 2 wherein the security member has a handle means extending from the side of the box when the support member is fully inserted in the box which acts as a visible indication that the locking means is in position.

4. An anti-theft box according to claim 2 wherein the security member is in the form of a flat horizontal surface.

5. An anti-theft box according to claim 2 wherein the release means applies magnetic force to the box to release the security member from the locking means.

6. An anti-theft box according to claim 3 wherein the security member has a pin at its end farthest from said opening in said box and the locking means locks the pin in position.

7. An anti-theft box according to claim 6 wherein the locking means includes a crimping device that locks the pin in position.

* * * * *

UNITED STATES PATENT AND TRADEMARK OFFICE

CERTIFICATE OF CORRECTION

PATENT NO. : 5,873,457

DATED : February 23, 1999

INVENTOR(S) : Madwed; Mark

It is certified that error appears in the above-identified patent and that said Letters Patent is hereby corrected as shown below:

On the title page, [75], "Mark Madweb" should read -- Mark Madwed --.

Under Item [19], " Madweb " should read -- Madwed --.

Signed and Sealed this

Tenth Day of October, 2000

*Attest:*

*Attesting Officer*

Q. TODD DICKINSON

*Director of Patents and Trademarks*